United States Patent [19]

Padgett

[11] Patent Number: 4,597,119

[45] Date of Patent: Jul. 1, 1986

[54] SUNTANNING DEVICE

[76] Inventor: Edwin Padgett, P.O. Box 400, Lady Lake, Fla. 32659

[21] Appl. No.: 682,253

[22] Filed: Dec. 17, 1984

[51] Int. Cl.[4] ..... A47C 20/00; A61G 7/00; A61H 33/00

[52] U.S. Cl. ..... 5/431; 5/60; 5/61; 128/372; 128/377

[58] Field of Search ..... 5/60–62, 5/111, 431; 128/372, 373, 376, 377; 108/20

[56] References Cited

U.S. PATENT DOCUMENTS

| | | | |
|---|---|---|---|
| 1,104,390 | 7/1914 | Stanley | 5/60 |
| 1,118,851 | 11/1914 | Turner | 108/20 |
| 1,444,042 | 2/1923 | Schwalbach | 108/20 |
| 1,581,994 | 4/1926 | Duncan | 5/60 |
| 1,631,888 | 6/1927 | Pow . | |
| 2,911,245 | 11/1959 | Kurz | 5/111 |
| 3,602,927 | 9/1971 | Wyss | 5/111 |
| 3,646,896 | 3/1972 | Derujinsky et al. | 5/419 |
| 3,713,619 | 1/1973 | Marty | 248/425 |
| 4,140,128 | 2/1979 | Van Der Schaaf | 128/376 |
| 4,360,936 | 11/1982 | Keller . | |
| 4,379,588 | 4/1983 | Speice | 128/372 |
| 4,441,220 | 4/1984 | Peterson | 5/431 |

FOREIGN PATENT DOCUMENTS

| | | | |
|---|---|---|---|
| 245197 | 1/1926 | United Kingdom | 5/60 |

*Primary Examiner*—Gary L. Smith
*Assistant Examiner*—Michael F. Trettel
*Attorney, Agent, or Firm*—Oltman and Flynn

[57] ABSTRACT

Suntanning device with a frame for supporting a person seeking sun exposure. The frame is rotatably supported on a support structure, so that the person resting on the frame can conveniently turn his body about a vertical axis of rotation while suntanning, and thereby gain an even sun exposure for best suntanning results. In the preferred embodiment, a drive mechanism is provided which slowly rotates the frame. The drive mechanism may contain a wind-up spring or an electric motor, or may be based on a gravity drive mechanism with a circular, downward sloping ramp. In one embodiment the suntanning device is made of inflatable parts that can be collapsed for easy transport. Another embodiment has an articulated frame and folding legs for easy transport.

2 Claims, 27 Drawing Figures

SUNTANNING DEVICE

BACKGROUND

The invention relates to suntanning devices, and more particularly to a suntanning device for body support for a person reclining in different positions to obtain enhanced sun exposure.

Persons seeking to suntan usually wish to attain an evenly distributed degree of suntan over the greatest part of their bodies, which is generally considered to be aesthetically pleasing.

It has long been known to use lounging chairs and reclining chairs that can be adjusted, so that a person reposing therein can be assuming various angles of exposure to the sun. Such devices, however, have the drawback that a person using one must get up from time to time to readjust it or move it to a different angle in relation to the sun, which is inconvenient and detracts from the pleasure of relaxing while suntanning.

Other inventors have in the past devised means for moving and manipulating a person reposing on a bed or frame.

U.S. Pat. No. 4,360,936 shows a pivoting bed supported on its underside at a pivot point.

U.S. Pat. No. 3,713,619 shows a revolvable device for aiding the movement of partially disabled persons.

U.S. Pat. No. 1,631,888 shows a hospital bed which includes a frame that can be pivoted and rotated about two axes for supporting a person on the bed.

The instant invention provides a device for suntanning, that can be readily adjusted to different angles in relation to the sun, without the need for getting up and moving around.

SUMMARY OF THE INVENTION

The instant disclosure shows a frame for supporting a person and which can be readily rotated about a vertical axis by a person reposing on a web, cushion or mattress suspended between the frame members, or disposed atop thereon. The invention, in its most basic form, comprises a wind-up spring and hand crank for winding the spring within easy reach of the reposing person and which engages means for rotating the frame.

The invention may further comprise a readily reachable and adjustable brake that restrains or controls the speed of the rotation of the frame.

The invention may further still comprise means for adjusting the contour of the frame at selected pivot points, so that a most desirable contour of the frame for reclining thereon, is attained.

The frame may further still have legs that are articulated so that the entire frame with legs can be easily folded for compactness and easy transportation.

In another embodiment, the suntanning device may comprise an electric motor with speed reducer that can slowly rotate the device with a person reposing thereon.

In still another embodiment, the suntanning device may comprise an inflatable structure that can be inflated to support a person and is rotatable by means of a part of the bed that is immersed and floating in another part containing water.

Such an inflatable structure has the advantage of being collapsible and compact in the deflated condition and has low weight.

Other objects of this invention will appear from the following description and appended claims, reference being had to the accompanying drawings forming a part of this specification wherein like reference characters designate corresponding parts in the several views.

FIGS. *7a–c* show enlarged exploded detail views of the rotary parts and the centerpost with pawl and ratchet.

Figure 8:
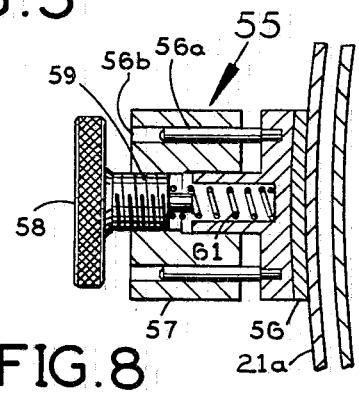
Figure 6:
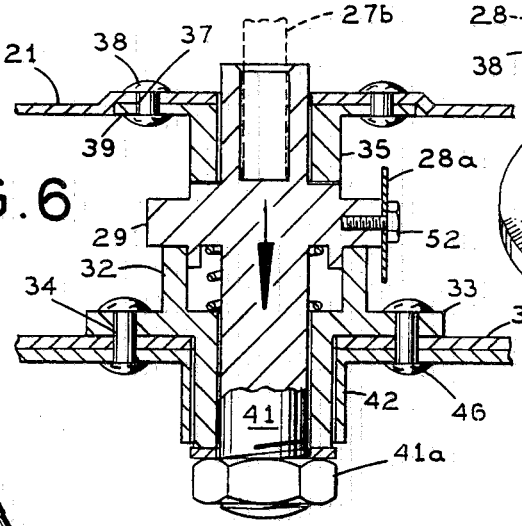
FIG. 6 is a vertical fragmentary cross-sectional detail view of the central rotary parts of the invention, showing the centerpost and adjoining elements, seen along the line 6—6 of FIG. 5.

FIG. 8 is a fragmentary, part cross-sectional detail view of the brake mechanism.

Figure 9:
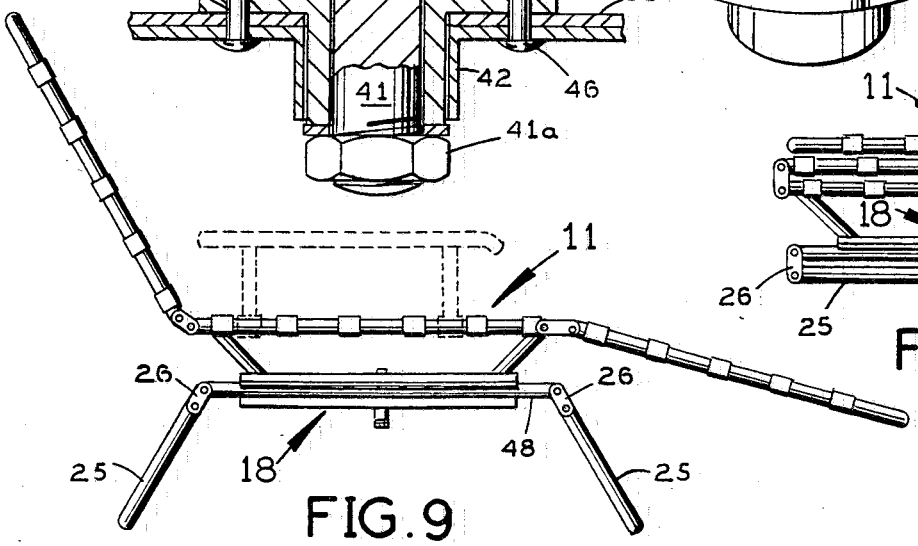

FIG. 9 is a vertical elevational side view of the invention showing the articulated frame construction.

Figure 10:
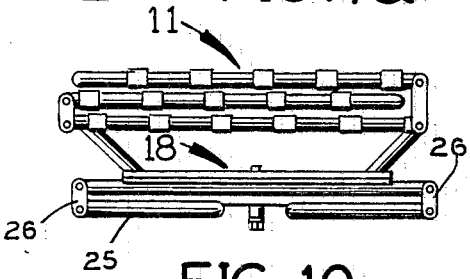

FIG. 10 is an end view of the invention in its collapsed folded condition.

Figure 11:
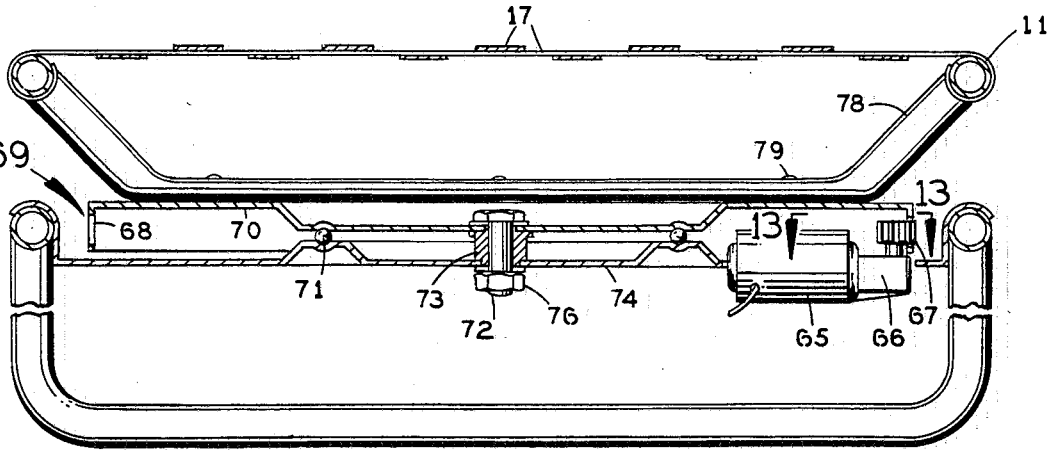

FIG. 11 is an elevational, part cross-sectional end view of the invention showing an electric motor drive mechanism.

Figure 12:
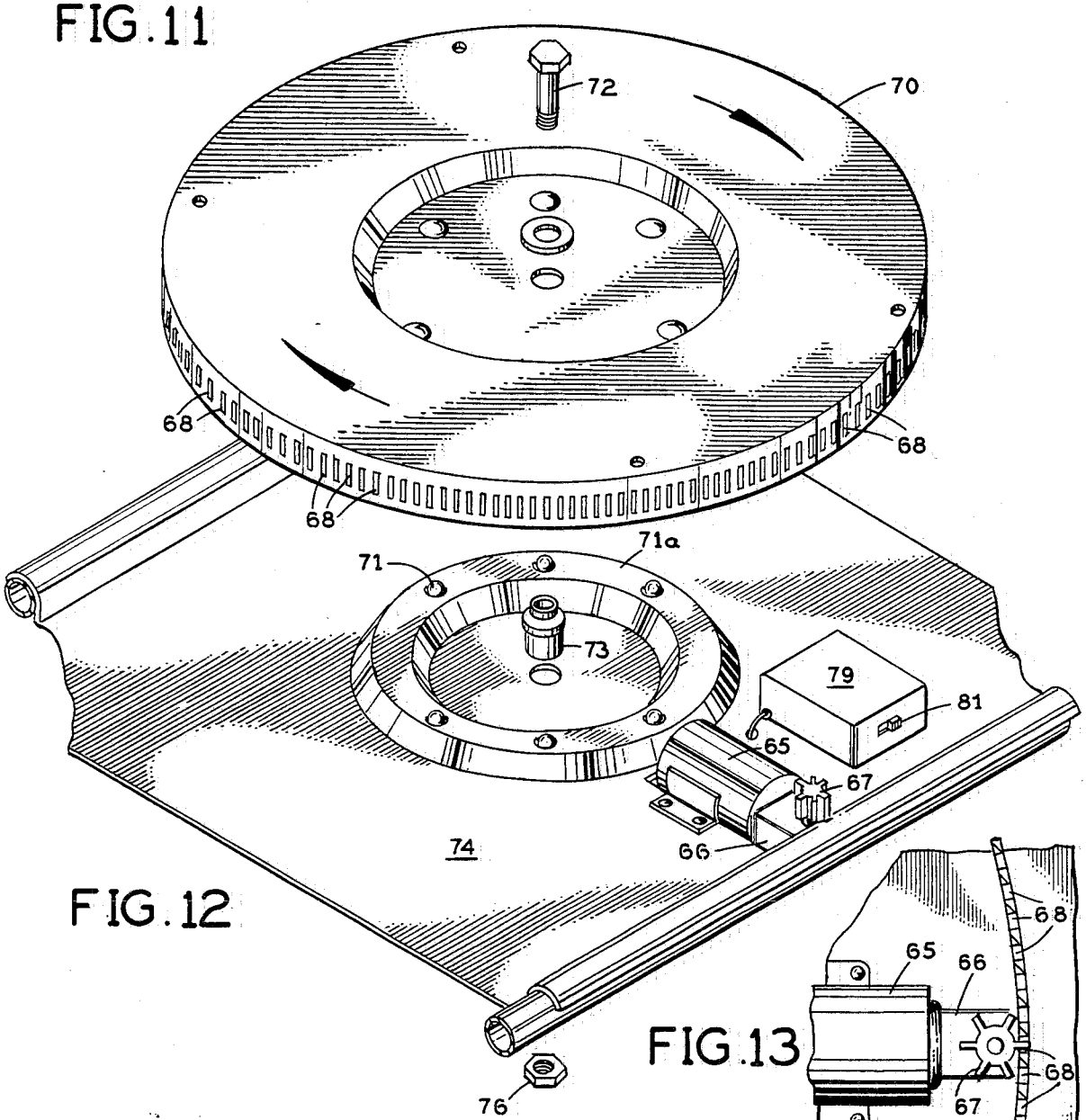

FIG. 12 is an exploded, perspective, fragmentary detail view of the elements of the electric drive mechanism.

Figure 13:
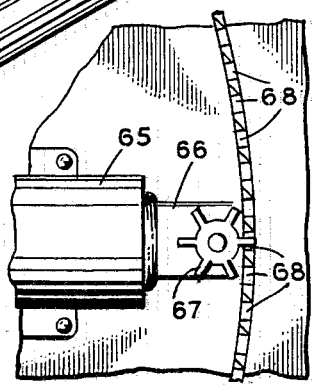

FIG. 13 is a top-down fragmentary detail view of the electric motor with reduction gear and pinion, and part of the toothed rim of the rotary support plate, seen along the line 13—13 of FIG. 11.

Figure 14:
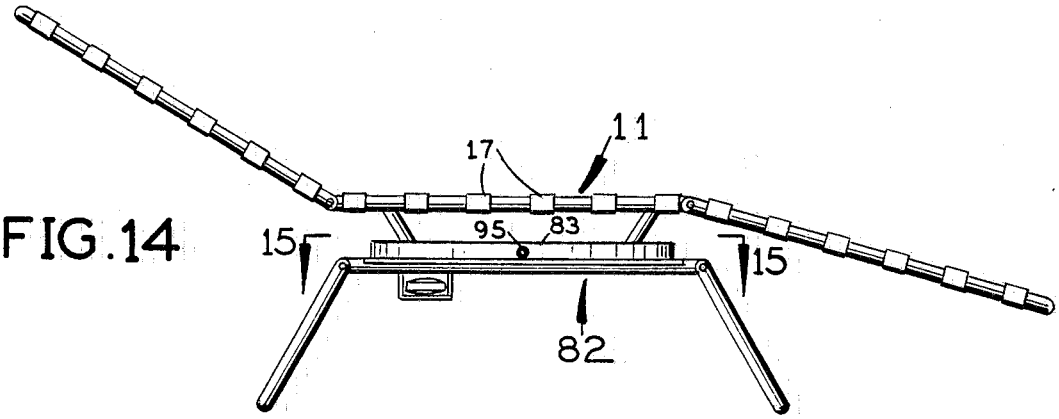

FIG. 14 is an elevational side view of the invention showing an air-operated rotary drive mechanism with a circular ramp.

Figure 15:
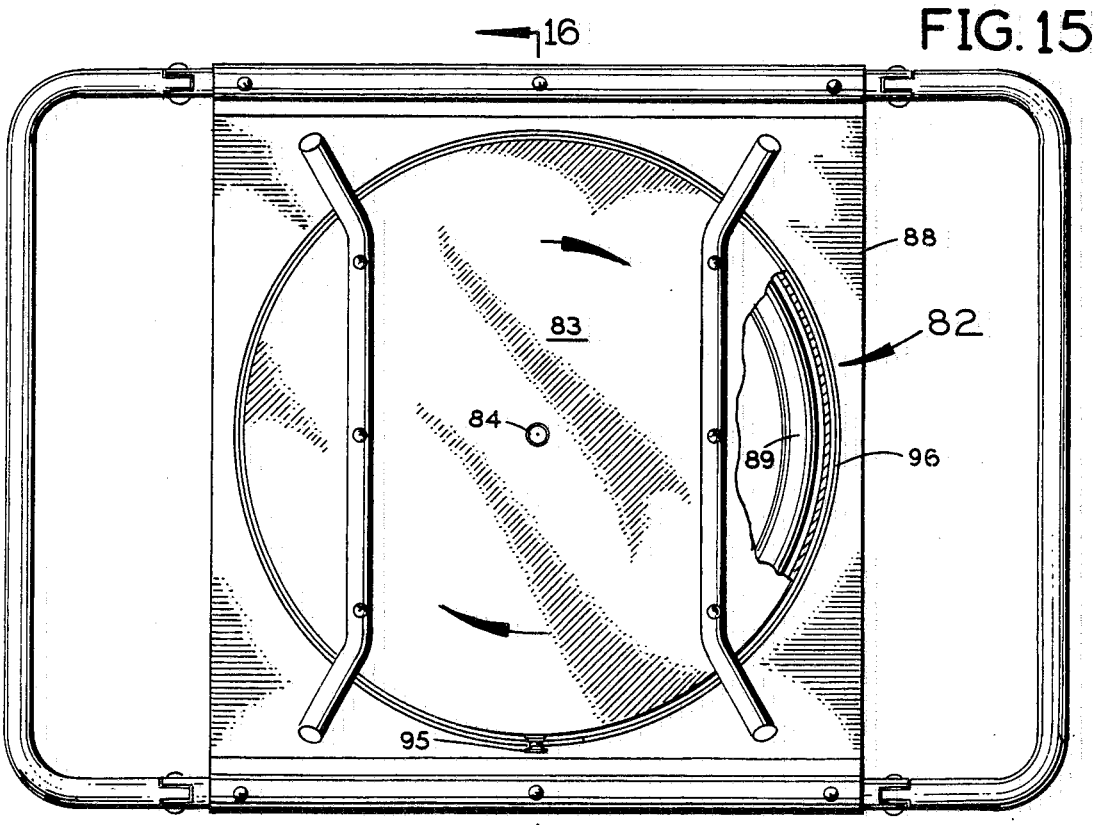

FIG. 15 is a top-down, part cross-sectional view of details of the air-operated drive mechanism with a part broken away to show the inflatable air hose, seen along the line 15—15 of FIG. 14.

Figure 16:
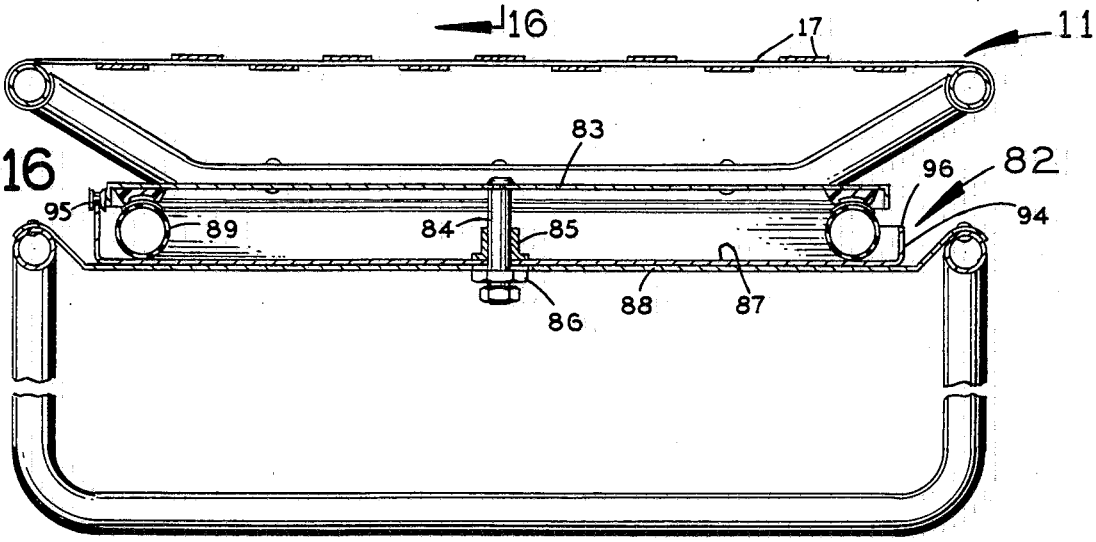

FIG. 16 is a part cross-sectional end view of the details of the air-operated drive mechanism with the ramp.

Figure 17:
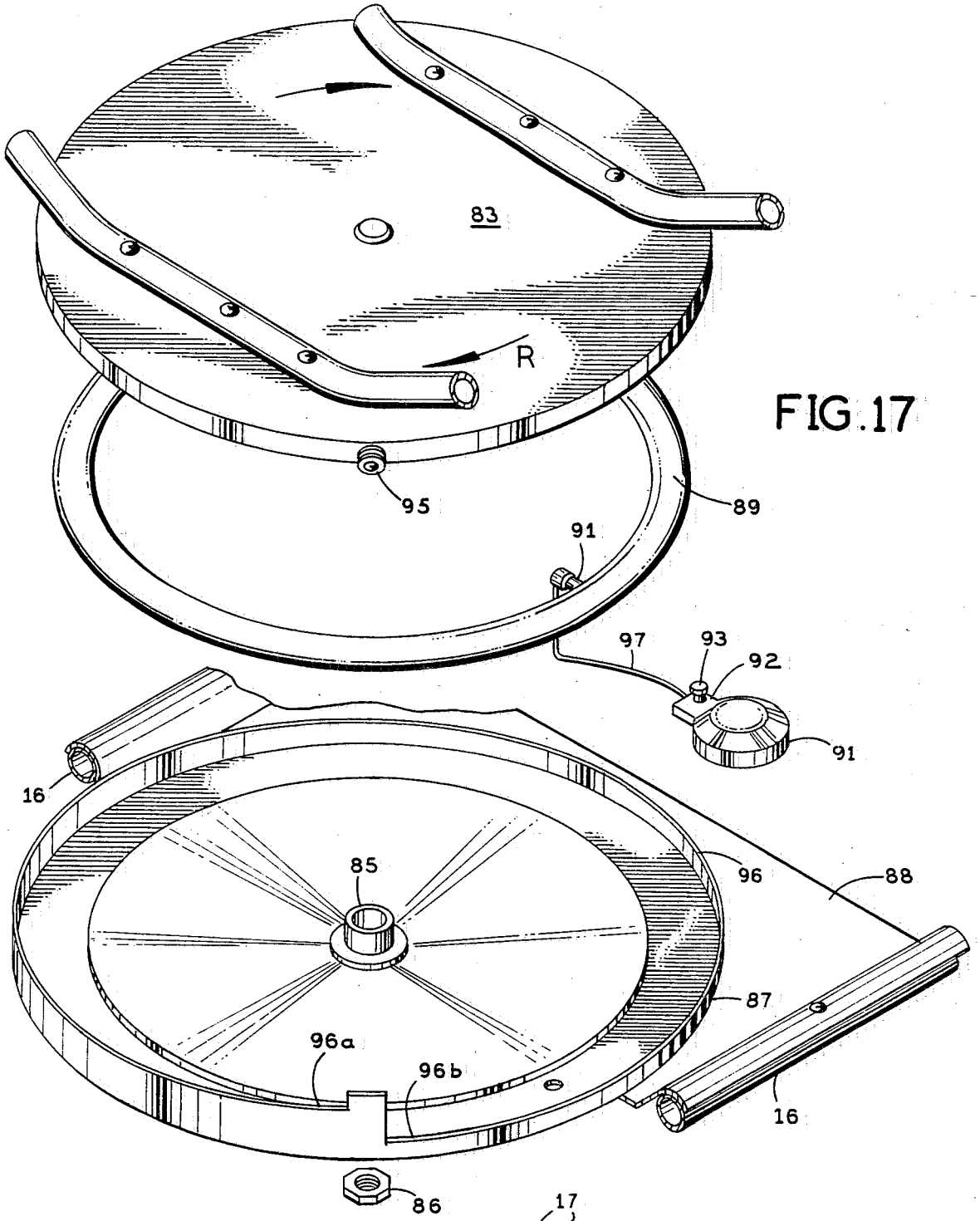

FIG. 17 is an exploded, perspective, fragmentary view of the elements of the air-operated drive mechanism.

Figure 18:
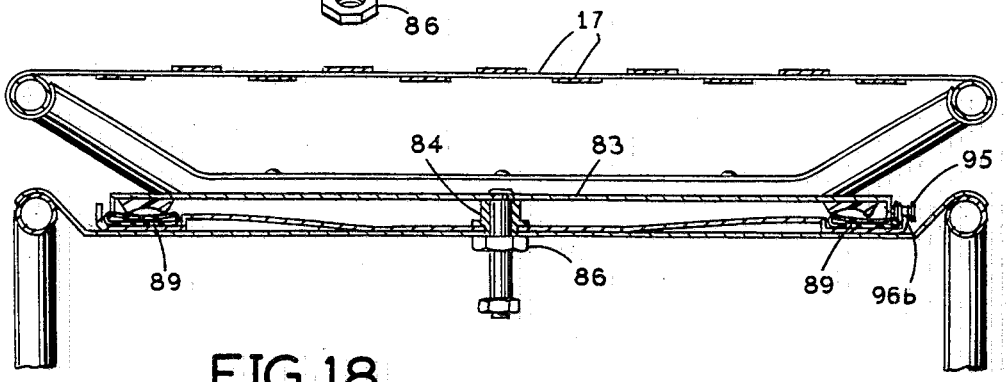

FIG. 18 is a fragmentary enlarged detail view of the air-operated drive mechanism with the inflatable air hose in collapsed condition.

Figure 19:
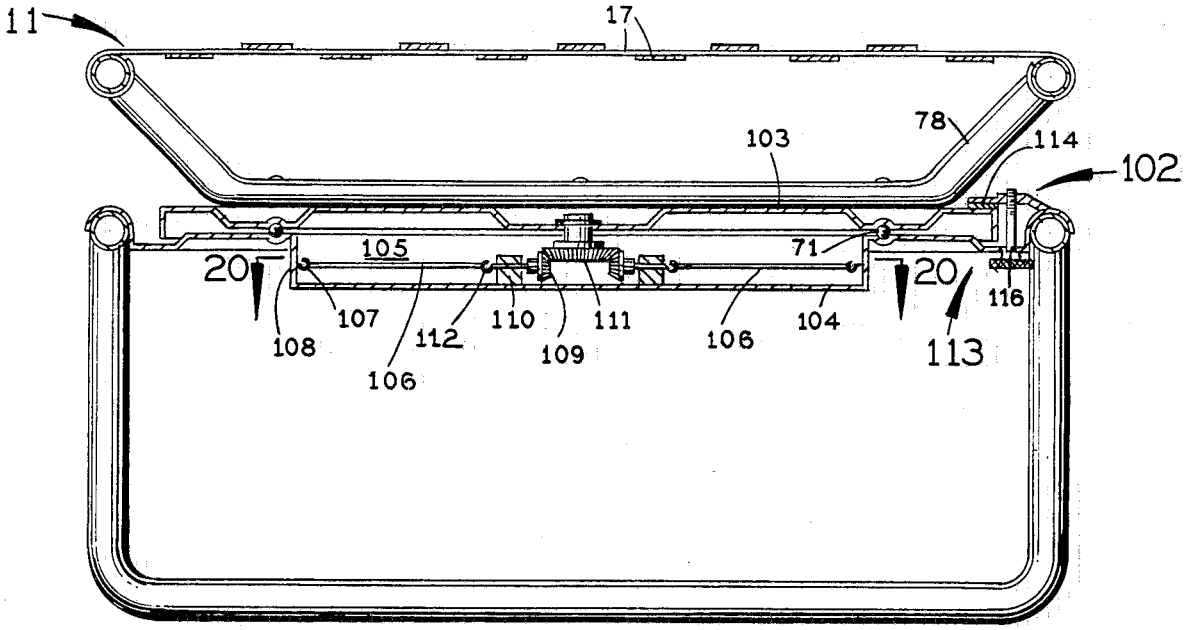

FIG. 19 is a cross-sectional end view of the invention showing a wind-up drive mechanism using rubber bands.

Figure 20:
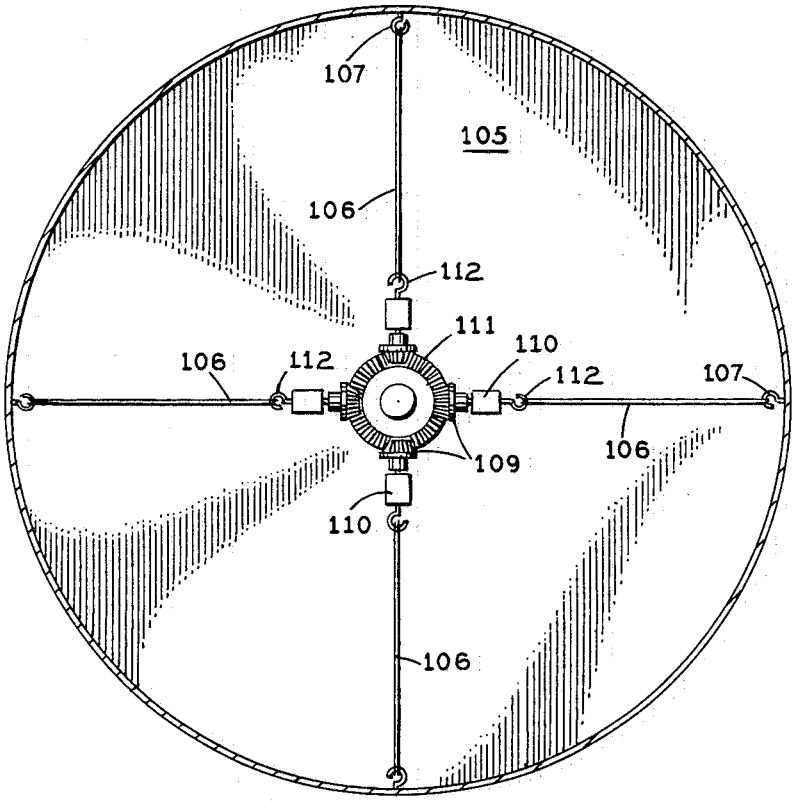

FIG. 20 is a fragmentary detail view of the wind-up mechanism of FIG. 19 taken along the line 20—20 of FIG. 19.

Figure 21:
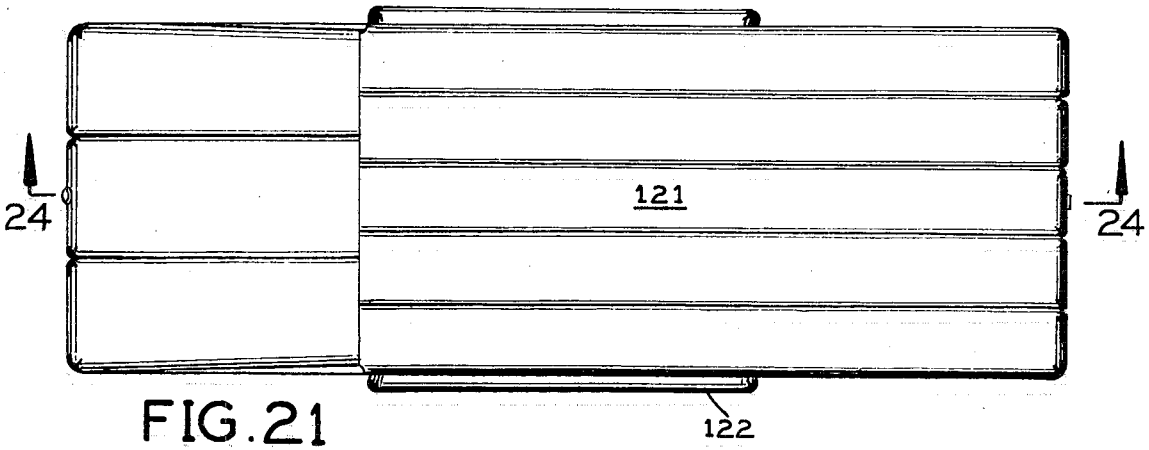

FIG. 21 is a top-down plan view of an inflatable embodiment.

Figure 22:
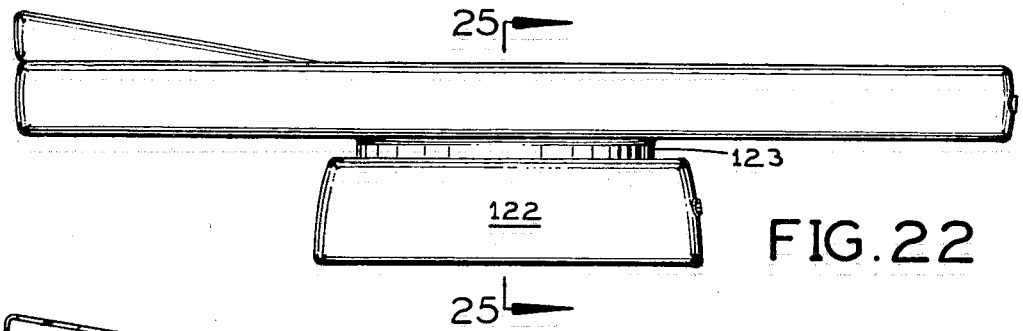

FIG. 22 is an elevational side view of the embodiment of FIG. 21.

Figure 23:
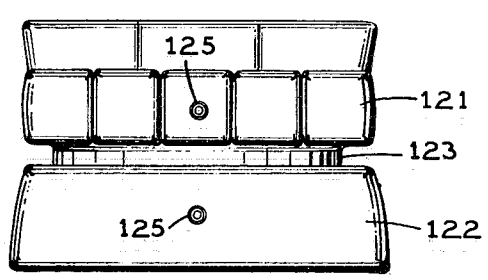

FIG. 23 is an elevational end view of the embodiment of FIG. 21.

Figure 24:
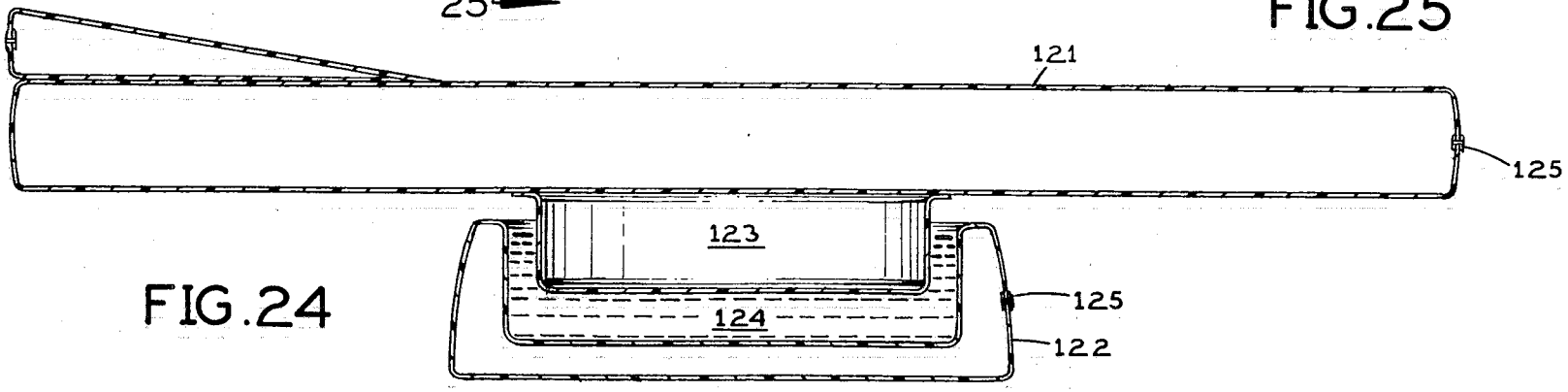

FIG. 24 is a vertical cross-sectional longitudinal view of the embodiment of FIG. 21.

Figure 25:
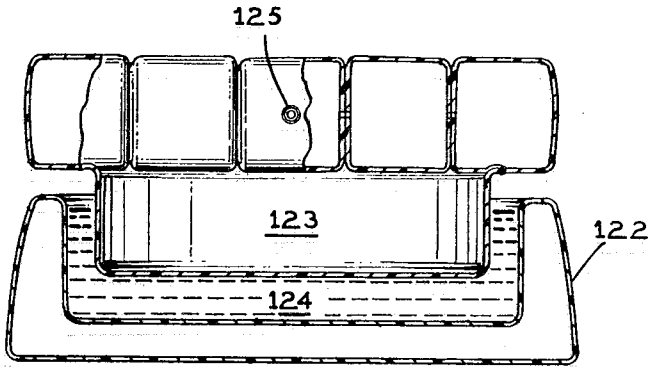

FIG. 25 is a cross-sectional transverse view of the embodiment of FIG. 21.

DETAILED DESCRIPTION OF THE PREFERRED EMBODIMENTS

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Figure 1:
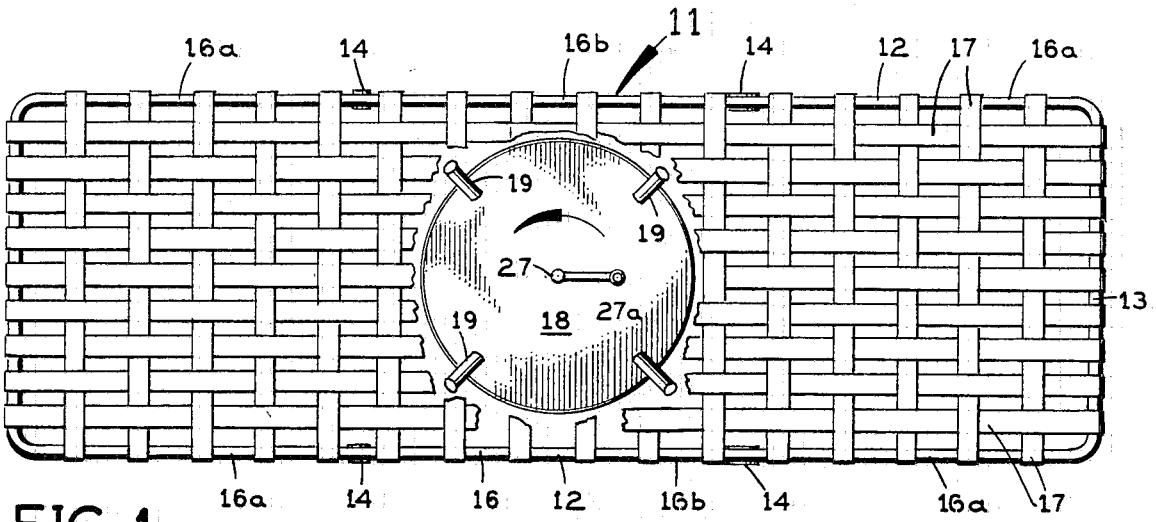
FIG. 1 is a plan view of the suntanning device with part of the web broken away to show the supporting under-structure.

FIG. 1 is a top-down view of the suntanning device, showing an articulated frame 11 consisting of two short end members 13 and two long, articulated side members 12, each consisting of individual sections, namely the end sections 16*a* and the middle sections 16*b*, which are joined by pivot points 14. The area between the frame members is filled by a web 17 suitable for supporting a person reclining thereon. The web 17 may advantageously consist of interlaced flat straps of plastic or fabric, or the entire area may be filled with a suitable fabric, attached at the edges to the frame members in well known manner.

At the center of the area a part of the web 17 is shown cut away to show a support structure 18, disposed below the frame 11. The support structure 18 has four upward projecting braces 19 that are rigidly attached at their upper ends to the middle sections 16*b*, advantageously at the pivot points 14, for supporting the weight of a person reclining on the web 17 of the frame 11. At their lower ends the braces 19 are rigidly attached to a circular rotatable support plate 21 that is part of the support structure 18 and is rotatably attached thereto so that the entire frame 11 is rotatable about a vertical axis. The support structure 18 is shown in more detail in FIGS. 5, 6, 7, 8 and 9 and will be described herein, infra.

Figure 2:
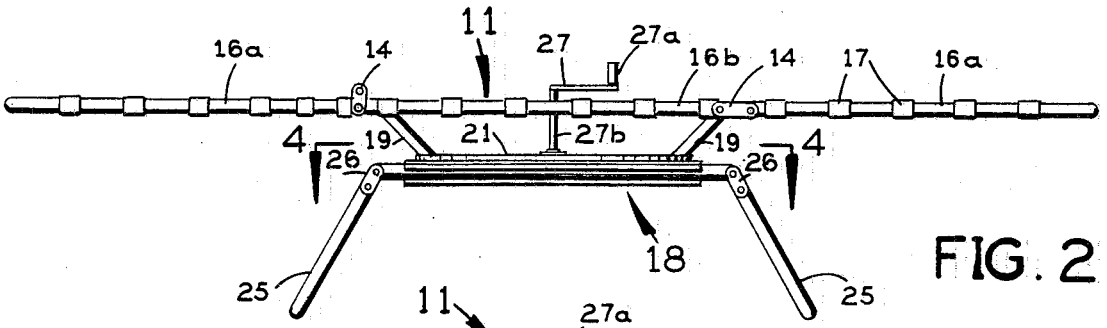
FIG. 2 is an elevational side view of the suntanning device showing the invention with the supporting under-structure.

FIG. 2 is a side view of the suntanning device showing the frame 11, consisting of sections 16*a* and 16*b* which are pivotally connected together at the pivot points 14. FIG. 2 also shows the rotatable support structure 18 in a side view, showing two U-shaped folding legs 25 that are pivotally attached to the support structure 18 at pivot points 26.

Figure 3:
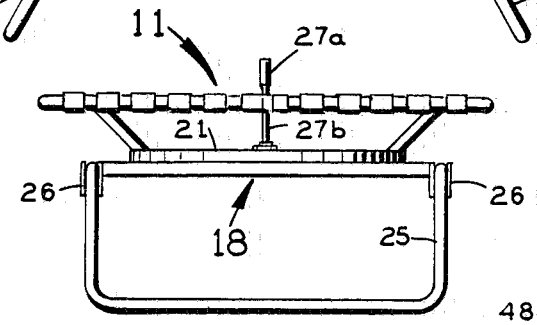
FIG. 3 is an elevational end view of the invention showing the frame and the under-structure.

FIG. 3 is the suntanning device seen in an end view, showing the frame 11, the rotatable support structure 18 and the U-shaped folding legs 25, attached at the upper ends of the legs of the U to the support structure 18 at pivot points 26.

Figure 4:
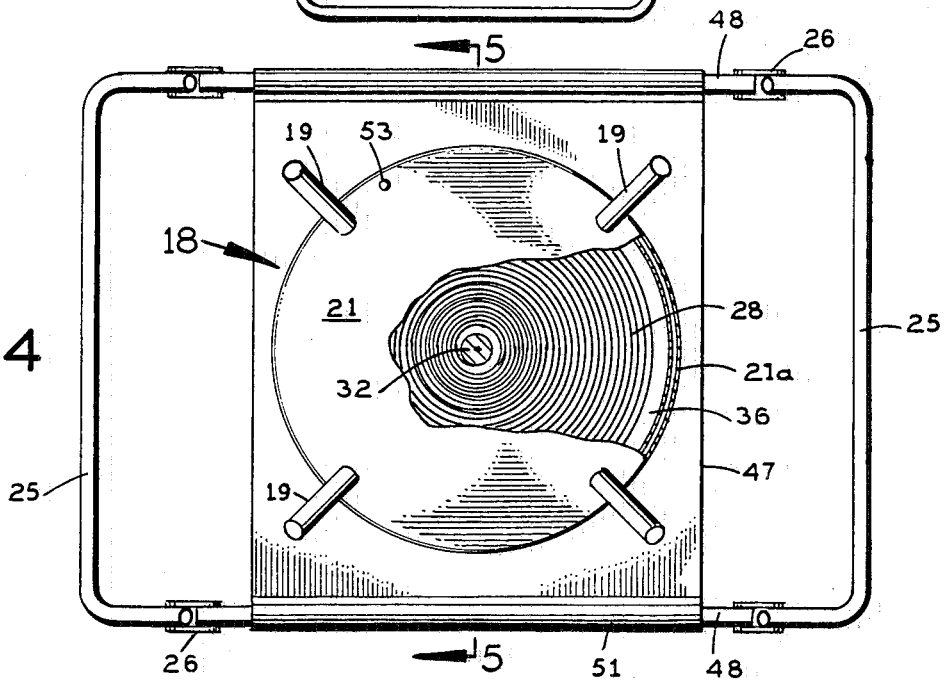
FIG. 4 is a plan top-down view of the invention taken along the line 4—4 of FIG. 2.

FIG. 4 shows a top-down view of the suntanning device taken along the line 4—4 of FIG. 2, showing the support structure 18 and part of the rotatable support plate 21 broken away to show part of a large spiral-shaped spring 28 contained inside the support structure 18.

Figure 7C:
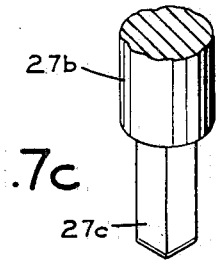
Figure 7B:
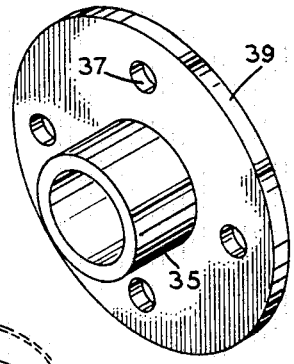
Figure 7A:
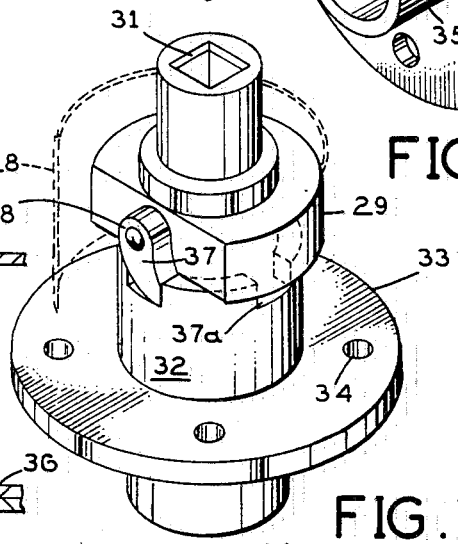

The spring 18 is part of an energy storage mechanism that can be wound up like a large clock spring by means of a detachable crank 27, shown in FIGS. 1, 2 and 3, in which the crank 27 has a crank handle 27*a* and a shaft 27*b*. The crank 27 can be inserted from the top down through an opening in the web 17 to engage a rotatable centerpost 29, best seen in FIGS. 5, 6 and 7*a*–*c*. The lower end of the crank shaft 27*b* is terminated in a square tap 27*c* which matches a square hole 31 in the round centerpost 29. The rotatable centerpost 29 is received, freely rotatable through an upper bushing 35, best seen in the detail FIG. 7*b*. FIG. 7*a* shows a lower bushing 32 having a bottom flange 33 with holes 34 for attachment of the flange 33 to the circular bottom 36 of the support structure 18. The upper bushing 35 is attached by a flange 39 and rivets 38 through rivet holes 37 to the underside of the rotatable circular support plate 21. The centerpost 29 extends downward in a cylindrical projection 41 which is received freely rotatable in a matching downward extension 42 of the lower bushing 32, and is secured against axial upward movement by a nut 41*a* threadedly attached to the bottom end of the lower projection 41.

The circular bottom 36 is rigidly attached to a bottom pan 47 by means of rivets 49 to two horizontal support rods 48 which are in turn attached at the pivot points 26 to the U-shaped legs 25. The support rods 48 are rigidly attached by rivets, welding or other suitable means to the lateral edges 51 of the bottom pan 47.

Figure 5:
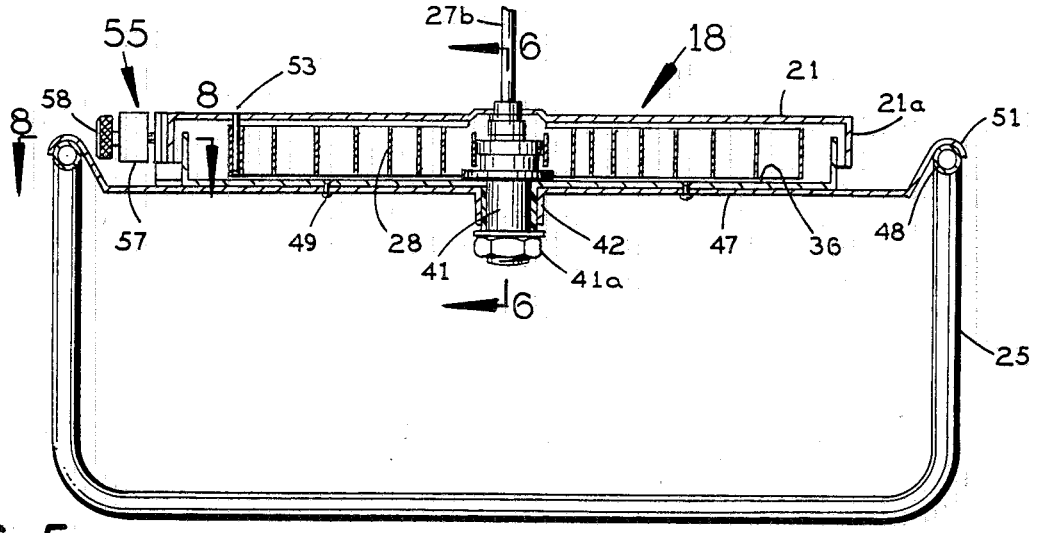
FIG. 5 is a vertical cross-sectional view of the suntanning device according to FIG. 4, seen along the line 5—5 of FIG. 4.

The spiral spring 28 is, at its inner end 28*a*, attached to a horizontal screw 52, which extends radially from the centerpost 29 and is rigidly attached thereto, while the outer end of the spring is attached to an outer post 53, best seen in FIGS. 4 and 5, which extends downward from the upper rotatable support plate 21 and is rigidly attached thereto.

The upper support plate 21 has a peripheral downward projecting outer rim 21*a* (FIGS. 4, 5 and 8) that engages a brake assembly 5 which operates to apply an adjustable amount of braking friction to the rotatable support plate 21.

The brake assembly 55, best seen in detail in FIG. 8, consists of a brake shoe 56 which is guided horizontally by guide pins 56*a*, received slidably in matching holes 56*b* in a brake support bracket 57 which is in turn rigidly attached to the bottom pan 47. An adjusting knob 58, threadedly received in a threaded hole 59 engages an adjusting spring 61 which is interposed between the adjusting knob 58 and the brake shoe 56. The friction between the brake shoe 56 and the outer rim 21*a* of the support plate 21 can be increased by turning the adjusting knob 58 clockwise, which compresses the adjusting spring 61, which in turn increases the friction between the brake shoe 21 and the rim 21*a*.

In operation, the suntanning device is activated by inserting the crank 27 into the square hole 31 of the center post 29 and turning the post 29 clockwise, as seen from above looking down, thereby winding up the spiral spring 29. The pawl 37 engaging the detents 37*a* in the lower bushing 32 prevents the spring 28 from unwinding when the crank 27 is removed after winding up the spring 28. The rotary spring force exerted by the outer end of spiral spring 28 on the rotatable circular support plate 21 via the outer post 53 will urge the support plate 21 to rotate in clockwise direction, with the frame 11, supporting a person reclining on the web 17. By means of the adjustable brake assembly 55, the braking friction against the rotatable support plate can be adjusted so that a desirable slow speed of rotation is attained.

It follows that the brake assembly 55 may be configured in other suitable ways in order to control the speed of rotation. One such other suitable way may comprise a well known clock type escapement which engages teeth attached to the rim 21*a* of the support plate 21, or a fluid damped retarding mechanism of conventional construction, or any other suitable retarding arrangement.

It also follows that other types of driving mechanisms may be used to rotate the tanning device, such as an electric motor that may be energized from batteries or from the power means. FIGS. 11, 12 and 13, show details of an embodiment using an electric motor 65 coupled via a speed reducer 66 and pinion 67 to teeth 68 cut into the outer rim 69 of a circular rotatable support plate 70 of a construction that is similar to that of the support plate 21 described hereinabove. The support plate 70 rotates on friction-reducing steel balls 71 about a shaft 72, received in a bushing 73. The steel balls 71 are contained in a ball race formed between the support plate 70 and the bottom plate 74. A nut 76, threadedly attached to the shaft 72, serves to keep the support plate 70 and the bottom plate 74 from separating. Transverse braces 78 attached by rivets 79 to the topside of the support plate 70, serve to support the frame 11, with the web 17 as described hereinabove.

FIG. 12 is an exploded view of the hereinabove described embodiment, showing the circular support plate 70 with the toothed rim 68, the steel balls 71 in a ball race 71*a*, the electric motor 65 with the speed reducer 66 and the pinion 67 for engaging the toothed rim 68 and a battery pack 79 with an on-off switch 81.

FIG. 13 is an enlarged fragmentary detail view of the electric motor 65 with the speed reducer 66 and the pinion 67.

FIG. 14 is an elevational side view of still another embodiment of the invention using a gently sloping circular ramp for rotating the suntanning device, which is also seen in a plan top-down view in FIG. 15 and in a transverse cross-sectional view in FIG. 16.

In FIGS. 14, 15, 16, 17 and 18 the suntanning device has an articulated frame 11 covered by a web 17 for supporting a reclining person, as shown in FIGS. 1 and 2. In FIG. 15 part of the web 17 is cut away to show a support structure 82 therebelow, consisting of a rotary, circular support plate 83 rotatably attached to a central shaft 84 (FIG. 16) loosely received axially slidable and rotatable in a bushing 85, which is in turn rigidly and perpendicularly attached to a lower circular plate 87 attached to a bottom pan 88.

The circular rotary support plate 83 is raised to a short distance above the lower circular plate 87 by an inflated circular rubber tube 89 which has an inward facing one way valve 91 for inflating the tube. Another valve 92 provides an adjustable air leakage that can be adjusted by a screw 93. The lower circular plate 87 has an upward projecting peripheral, circular rim 94 which is shaped like a 360 degree circular gently sloping ramp 96 best seen in the exploded view FIG. 17. The upper support plate 83 has a small freely rotatable roller 95 which rides on the sloping ramp 96. An air pump 91 serves to inflate the rubber tube 89.

In operation, the rubber tube 89 is inflated by means of the pump 91 via the small tube 97 which is in fluid communication with the interior space of the inflatable tube 89. After inflation, the upper rotary support plate 83 is rotated so that the roller 95 rests on the highest point 96*a* of the ramp 96, and the air leakage valve 92 is adjusted to bleed from the inflatable tube 89 at a selected slow rate. As the tube 89 is slowly deflated, the upper rotary plate 83, which rests on and is supported by the tube 89, sinks downward at a slow rate. The roller 95, rolling on the downward sloping ramp 96 imparts a slowly acting rotary movement to the support plate 83 which causes it to turn slowly in the direction indicated by the arrow R in FIG. 17. When the inflatable tube 89 is completely deflated, as shown in FIG. 18, the roller 95 will have come to the lowest point 96*b* on the ramp 96 and the support plate 83 will have completed an almost complete 360 degree turn.

Still another embodiment of the invention is shown in FIGS. 19 and 20.

FIG. 19 shows an upper rotating frame 11 with a web 17 for supporting a reclining person. The frame is attached by braces 78 to a support structure 102 which is described hereinbelow. The support structure 102 has an upper circular support plate 103 resting on low friction steel balls 71 as shown hereinabove in FIG. 11. The steel balls 71 can roll in a circular ball race formed by the support plate 103 and a bottom pan 104 having a circular shallow disk-shaped cavity 105 containing a wind-up energy storage mechanism. The wind-up mechanism consists of a plurality of radially oriented rubber bands 106 attached at their outer ends to hooks 107 which are, in turn, fastened to the outer circular wall 108 of the cavity 105. The rubber bands 106 are, at their inner ends, attached to the shaft of a corresponding plurality of beveled pinions 109. Each pinion 109 engages a central bevel gear wheel 111 which is in turn connected by a short upward projecting shaft 112 which is rigidly attached to the rotary support plate 103. The shafts of the pinions 109 are guided through pillow blocks 110 and form, at their ends, small hooks 112 for receiving and holding the inner ends of the rubber bands 106.

An adjustable brake mechanism 113 consisting of a brake shoe 114 that can be tightened against the top surface of the rim of the rotary support plate 103 by means of a screw 116 that is threadedly engaging the brake shoe 114, serves to selectivly apply a certain amount of friction on the rotary plate 103 for controlling its speed of rotation. FIG. 20 is a top-down fragmentary plan view into the cavity 105 showing four rubber bands 106 each connected to the pinion 109. Each pinion 109 engages the center bevel gear 111, which is, in turn, attached to the rotary support plate 103 which carries the frame 11.

In operation, a person, before beginning to suntan, rotates the entire frame 11 with the rotary support plate 103 with the center bevel gear 111, thereby winding up the rubber bands 106 by twisting them. After winding up the rubber bands, the person may recline on the webbing 17, and, as the frame 11 slowly rotates, under control of the brake 113, the person is exposed to the sun's rays from constantly changing angles for obtaining a desirable even suntan.

Still another embodiment of the invention is shown in FIGS. 21, 22, 23, 24 and 25. This embodiment is an inflatable embodiment of the invention, having an inflatable planar support element 121 for supporting a reclining person thereon, an inflatable support structure 122, having a circular indentation 114 that can be filled with water and is coordinated with a circular inflatable float body 123 rigidly attached to the underside of the planar support element 121, so that the float body 123 can be immersed in the water in the indentation 124 and float threrein while it supports the weight of a person resting on the planar support element 121. The planar support element 121 can readily be rotated by the person resting thereon for attaining a desirable angle of sun exposure.

An air valve 125 is provided as part of the structure of the inflatable elements 121 and 122 for inflating and deflating the device.

I claim:

1. A rotatably adjustable reclining chair comprising:

a base;

a support plate above said base;

coupling means at the center of said support plate acting between said base and said support plate to permit rotation of said support plate horizontally above said base;

anti-friction bearings acting between said base and said support plate at a substantial distance laterally outward from said coupling means;

an electric motor mounted on said base;

a pinion operatively coupled to said motor to be driven thereby, said pinion being offset a substantial distance laterally outward from said coupling means and being rotatable about a vertical axis;

said support plate having means thereon providing a series of teeth in succession circularly about the rotational axis of the support plate at a substantial distance laterally outward from said coupling means, said teeth meshing in succession with said pinion as said support plate is rotated by the pinion;

a reclining chair frame with opposite side rails, each having a middle piece spaced above said support plate and opposite end pieces pivoted respectively to said middle piece for adjustment to selected angular positions with respect to said middle piece;

and rigid braces extending up from said support plate to said middle pieces of the chair frame side rails to support the chair frame for rotation in unison with said support plate.

2. A chair according to claim 1 wherein said base comprises:

pivoted legs respectively adjustable between a downwardly extending position and a retracted position folded next to the remainder of the base.

* * * * *